US011813515B2

(12) United States Patent
Engler et al.

(10) Patent No.: US 11,813,515 B2
(45) Date of Patent: Nov. 14, 2023

(54) TRAINING GLOVE

(71) Applicant: P&P IMPORTS LLC, Santa Ana, CA (US)

(72) Inventors: Peter H Engler, Newport Beach, CA (US); Peter L Tanoury, Newport Beach, CA (US); Daniel Andersson, Huntington Beach, CA (US)

( * ) Notice: Subject to any disclaimer, the term of this patent is extended or adjusted under 35 U.S.C. 154(b) by 0 days.

(21) Appl. No.: 16/452,371

(22) Filed: Jun. 25, 2019

(65) Prior Publication Data

US 2020/0406122 A1 Dec. 31, 2020

(51) Int. Cl.
*A63B 71/14* (2006.01)
*A41D 19/015* (2006.01)

(52) U.S. Cl.
CPC ..... *A63B 71/145* (2013.01); *A41D 19/01523* (2013.01); *A41D 2600/10* (2013.01)

(58) Field of Classification Search
CPC ..... A63B 71/14; A63B 71/141; A63B 71/145
See application file for complete search history.

(56) References Cited

U.S. PATENT DOCUMENTS 1,745,670 A * 2/1930 Gately ..... A63B 71/145 2/18
1,841,193 A * 1/1932 Lidston ..... A63B 71/143 2/16
2,291,184 A * 7/1942 Cartier ..... A63B 71/145 2/18
2,526,217 A * 10/1950 Gilman ..... A63B 69/345 473/444
2,552,177 A * 5/1951 Hurt ..... A41D 13/065 2/24
2,574,046 A * 11/1951 Logan ..... A63B 69/26 473/444
2,994,534 A * 8/1961 Davis ..... A63B 69/26 473/444
3,605,117 A * 9/1971 Latina ..... A63B 71/143 2/16
3,626,515 A * 12/1971 Murray ..... A63B 71/143 2/16
3,663,960 A * 5/1972 Kennedy ..... A63B 71/145 2/18
3,855,633 A * 12/1974 Rhee ..... A63B 71/145 2/18
3,896,497 A * 7/1975 Rhee ..... A63B 71/145 2/20

(Continued)

OTHER PUBLICATIONS

Revgear, "Phoenix 1 Pinnacle Mitts" https://revgear.com/phoenix-1-pinnacle-mitts-mitt-and-glove-in-one/ (Year: 2023).*

(Continued)

*Primary Examiner* — Jocelyn Bravo

(57) ABSTRACT

A training glove, and methods of using the same are provided. The training glove includes a glove portion, wherein the glove portion includes a first protective portion disposed to cover at least a portion of the posterior of a user's hand when worn by the user. The training glove further includes a blocker portion, wherein the blocker portion is secured to the glove portion and includes a second protective portion disposed to cover a portion of a user's anterior forearm when worn by the user. The training glove further includes a retention system.

18 Claims, 15 Drawing Sheets

(56) References Cited

U.S. PATENT DOCUMENTS 4,137,572 A * 2/1979 Jansson ..... A63B 71/143 2/16
4,198,708 A * 4/1980 Fugere ..... A41D 13/0568 2/16
4,417,359 A * 11/1983 Johnson ..... A63B 71/145 2/16
4,484,359 A * 11/1984 Tirinen ..... A41D 19/01523 2/161.1
4,546,966 A * 10/1985 Segura ..... A63B 69/26 482/86
4,603,439 A * 8/1986 Golomb ..... A63B 71/145 2/18
RE32,287 E * 11/1986 Willis ..... A63B 71/148 2/16
4,700,404 A * 10/1987 Potvin ..... A63B 71/143 2/16
4,756,026 A * 7/1988 Pierce, Jr. ..... A63B 71/12 2/16
4,784,120 A * 11/1988 Thomas ..... A47G 21/08 248/118
4,800,119 A * 1/1989 Kolar ..... B32B 5/18 442/373
4,869,267 A * 9/1989 Grim ..... A43B 7/20 602/27
4,926,501 A * 5/1990 Goosen ..... A61F 13/06 2/16
4,942,624 A * 7/1990 Cho ..... A63B 71/08 2/16
5,107,544 A * 4/1992 Capatosto ..... A63B 71/143 2/16
5,146,624 A * 9/1992 Bruckner ..... A63B 71/145 2/16
5,218,718 A * 6/1993 Chih ..... A63B 71/143 2/16
5,335,888 A * 8/1994 Thomsen ..... A47B 21/0371 2/16
5,564,122 A * 10/1996 Wagner ..... A63B 71/143 2/16
5,617,580 A * 4/1997 DiCesare ..... A63B 71/1225 2/22
5,623,728 A * 4/1997 Wagner ..... A63B 71/12 2/16
5,647,062 A * 7/1997 Nigbur ..... A41D 13/08 2/16
5,655,221 A * 8/1997 Worischeck ..... A63B 71/12 2/16
5,781,935 A * 7/1998 Bassett ..... A41D 13/0568 2/16
5,840,397 A * 11/1998 Landi ..... A41D 31/285 428/73
5,944,289 A * 8/1999 Speece ..... A47B 21/0371 248/118.5
5,964,683 A * 10/1999 Norblom ..... A63B 69/26 2/1
5,983,391 A * 11/1999 Palmer ..... A41D 13/08 2/16
5,987,778 A * 11/1999 Stoner ..... A41D 17/00 36/1.5
6,085,352 A * 7/2000 Martin ..... A63B 71/14 2/16
6,226,795 B1 * 5/2001 Winningham ..... A41D 13/084 2/20
6,412,114 B1 * 7/2002 Carlin ..... A63B 71/12 128/882
6,691,316 B2 * 2/2004 Carlin ..... A63B 71/12 128/882
6,711,747 B2 * 3/2004 Carlin ..... A63B 71/12 2/16
7,013,487 B2 * 3/2006 Beland ..... A41D 13/05 2/22
7,096,508 B2 * 8/2006 Lesosky ..... A41D 13/065 2/24
7,725,950 B2 * 6/2010 Hinebaugh ..... A63B 71/14 2/16
8,287,437 B1 * 10/2012 Rovere ..... A63B 71/08 482/83
8,418,263 B2 * 4/2013 McVan ..... A63B 69/26 2/18
8,469,913 B1 * 6/2013 Jon ..... A61F 13/064 602/61
9,211,461 B2 * 12/2015 Marciano ..... A63B 71/14
9,320,954 B1 * 4/2016 Simpkins ..... A63B 71/0622
9,901,130 B2 * 2/2018 Morris ..... A41D 19/0037
10,124,239 B2 * 11/2018 Contant ..... A63B 71/143
10,145,656 B2 * 12/2018 Gaynor ..... F41H 5/08
10,814,209 B1 * 10/2020 Carlton ..... A63B 69/26
10,835,799 B2 * 11/2020 Monk ..... A63B 69/26
2002/0040494 A1 * 4/2002 Kleinert ..... A41D 19/015 2/161.1
2002/0073480 A1 * 6/2002 Phillips ..... A41D 13/08 2/455
2002/0148029 A1 * 10/2002 Carlin ..... A63B 71/14 2/16
2003/0000002 A1 * 1/2003 Carlin ..... A63B 71/12 2/17
2003/0154536 A1 * 8/2003 Anderson ..... A41D 3/02 2/108
2003/0217582 A1 * 11/2003 Reinbold ..... A63B 69/32 73/12.09
2004/0045079 A1 * 3/2004 Quintero ..... A63B 69/0002 2/455
2004/0123372 A1 * 7/2004 Kleinert ..... A63B 71/143 2/161.1
2004/0177431 A1 * 9/2004 Ferrer ..... A41D 19/01523 2/161.8
2005/0268365 A1 * 12/2005 Sandebeck ..... A63B 71/08 2/16
2008/0072358 A1 * 3/2008 Kleinert ..... A63B 71/143 2/21
2008/0244800 A1 * 10/2008 Zucker ..... A63B 71/145 2/18
2009/0176632 A1 * 7/2009 Wiber ..... A63B 69/004 482/84
2011/0088131 A1 * 4/2011 McVan ..... A63B 69/26 2/18
2014/0215675 A1 * 8/2014 Clauder ..... A63B 71/145 2/18
2016/0029719 A1 * 2/2016 Morris ..... A41D 19/01517 2/160
2016/0038821 A1 * 2/2016 Mackey ..... A43B 1/0072 2/459
2016/0198779 A1 * 7/2016 McPhail ..... A63B 71/141 2/162
2017/0001091 A1 * 1/2017 Holmes ..... A63B 69/26
2017/0282048 A1 * 10/2017 Wittman ..... A63B 71/145
2019/0209907 A1 * 7/2019 Monk ..... A63B 69/20

OTHER PUBLICATIONS

TITLE Boxing, "TITLE Boxing Dual Purpose Combo Punch Mitts" https://www.titleboxing.com/title-boxing-dual-purpose-combo-punch-mitts (Year: 2023).*

* cited by examiner

TRAINING GLOVE

TECHNICAL FIELD

The present disclosure generally relates to sports training devices, and more particularly to a training glove with a glove portion and blocker portion.

BACKGROUND

Boxing and other combat sports such as kickboxing and mixed martial arts require intense physical training. For many years, individuals training in these sports have used hand protection in the form of boxing and sparing gloves. Boxing gloves protect the hands of the boxer and the body and face of the trainer by cushioning the punches thrown by the boxer at the trainer. Various boxing gloves have been developed over the years that include different closure systems amounts and types of padding, and changes to the outer materials from leather and natural fabrics to plastics and other synthetics.

During boxing training, an athlete may deliver substantial force when delivering a punch directed towards the trainer. In certain aspects, the trainer may want to use their hands as a target to receive the punches thrown by the athlete. In this case, it is common to desire additional hand protection to receive those punches. Thus, trainers commonly use specialized pads (or hand blockers) on their hands to cushion and receive the punches thrown by the athlete during training to minimize the force received by the trainer.

In other sports such as kickboxing, different types of strikes are permissible (e.g., kicking, knees, elbows, etc.). These different types of strikes typically use different types of training equipment. For example, when an athlete is practicing kicking strikes with a trainer, a trainer may use a larger pad (or kick blocker) to cushion the kicks thrown by the athlete rather than the relatively smaller hand blockers, as kicking generally tends to be less accurate and often delivers more force than a punch.

Kick blockers are typically rectangular pads that are attached to a user's posterior forearm (e.g., using straps, a handle, or a combination there of) to protect the back of the user's arm when receiving strikes from the training athlete. Other kick blockers have emerged that generally take the form of padding on a long wooden or plastic handle, or a large torso-sized blocker that requires both hands to operate effectively.

In nearly all combat sports, an athlete should not only be a proficient striker, but they should also be well versed in how to receive and avoid counter strikes given from their opponent.

While a typical boxing glove allows a trainer to comfortably deliver counter punches to an athlete they are training, it fails to provide sufficient hand padding for the trainer to cushion incoming strikes thrown by the athlete that are received in a portion of the palm region of the trainer's hand. Moreover, a boxing glove also fails to provide sufficient forearm padding for the trainer to receive kicks or other strikes from the athlete.

An example of a typical boxing glove is shown in FIG. 1. It will be appreciated that about the palm area 120 of boxing glove 100 is not well suited for receiving strikes from an athlete when those strikes are generally received in the palm area 120 of the user as traditional boxing gloves are designed with a relatively thin palm area 120. As further shown in FIG. 1, boxing glove 100 does not have padding for a user's forearm below about wrist area 130. Padding 110 is disposed to generally protect the posterior of a user's hand when worn.

Hand blockers allow a trainer to comfortably receive punches with the palm of their hands that are thrown from the athlete at the trainer. An example of a typical hand blocker is shown in FIG. 2. Hand blockers are not ideal for delivering counter punches to the athlete (e.g., because the padding is too dense/hard to be used against the athletes face and or body; because they prevent the trainer from striking with their first as the fingers remain straightened, etc.).

It will be appreciated that hand blockers, such as hand blocker 200 in FIG. 2, prevent the user of the hand blocker (e.g., the trainer, etc.) from generally curling their finger into a first or partial fist. While hand blocker 200 provides substantial padding for the palm of the user's hand compared to boxing glove 100 in FIG. 1, it will be appreciated that there is not substantial padding on the posterior of the user's hand (e.g., at glove section 220) or along the users forearm which would extend below the bottom the hand blocker 200. The combination of at least the lack of the ability of a user to form a fist, the lack of padding on the posterior of the user's hand/the density of edge 210, the shape of edge 210, etc. make hand blockers undesirable for delivering safe counter blows to a training athlete. Further, while a trainer may use a hand blocker to block kicks, it will be appreciated that it is poorly suited for kick training as kick blockers provide more robust padding of the trainer's arm and are generally a larger target for the athlete to engage. However, kick blockers have their own drawbacks.

FIG. 3 shows kick blocker 300. Kick blocker 300 allows the trainer to block strikes thrown from the athlete, but it is poorly suited for delivering counter strikes as it does not protect the posterior of a user's hand or the anterior of a user's forearm. Kick blocker 300 is worn by a user by placing the blocking portion on the posterior forearm of the user, gripping handle 320 and securing straps 330 around the anterior forearm. Kick blocker 300 is typically used to block kicks with the posterior forearm with the trainer's arm(s) traversed across the front of their body such that the pad side of kick blocker 300 is presented to an athlete being trained by the trainer.

It will be appreciated that because both hand blockers and kick blockers are commonly constructed with more robust padding than boxing gloves (e.g., thicker, denser, larger, etc.) they are undesirable for striking the athlete as the transfer of force may exceed the desirable range for comfortable but effective training (e.g., with edge 210 of hand blocker 200 in FIG. 2, edge 310 of kick blocker 300 in FIG. 3).

Thus, there exist a need for a more versatile training device that allows for more dynamic training of an athlete by allowing the athlete to safely practice various strikes (e.g., punches, kicks, knees, elbows, etc.) while allowing the trainer to safely deliver counter punches to the athlete during the same training session and without having to switch training devices (e.g., switch between boxing gloves, hand blockers, and kick blockers). Such a dynamic training device and methods of using the same are disclosed herein as set forth in more detail below. Other objects of the present disclosure will become apparent to those of ordinary skill in the art upon reading and understanding the following detailed description which includes the attached and incorporated figures.

SUMMARY

A training glove and methods of using the same are provided. The training glove includes a glove portion, wherein the glove portion includes a first protective portion disposed to cover at least a portion of the posterior of a user's hand when worn by the user. The training glove further includes a blocker portion, wherein the blocker portion is secured to the glove portion and includes a second protective portion disposed to cover a portion of a user's anterior forearm when worn by the user. The training glove further includes a retention system.

DESCRIPTION OF THE DRAWINGS

The present disclosure is more readily apparent from the specific description accompanied by the following drawings, in which.

DETAILED DESCRIPTION

Those of ordinary skill in the art will appreciate that depending on the particular application at hand, many modifications, substitutions and variations can be made in, and to, the materials, apparatus, configurations, and methods of using the device(s) of the present disclosure. The innovations herein are not limited to any of the particular embodiments that are illustrated and described herein. The description below is merely an explanation by way of some examples thereof that should be fully commensurate with that of the claims appended hereafter and their functional equivalents, and merely serves to inform one of ordinary skill in the art how to make and use the innovations disclosed herein and to provide the basic fundementals needed to enable the same.

Figure 1:
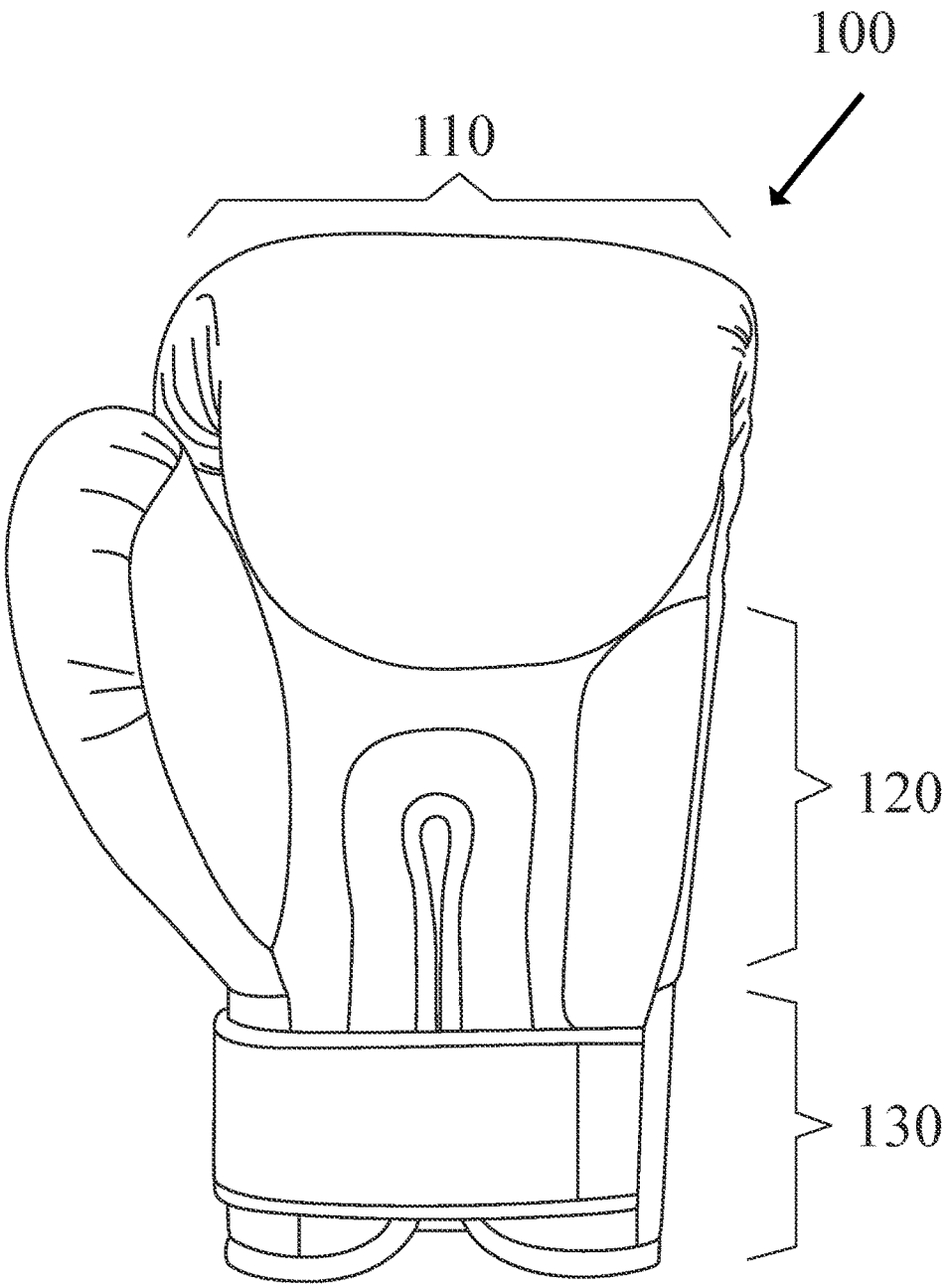
FIG. 1 is an illustration of a boxing glove.
Figure 2:
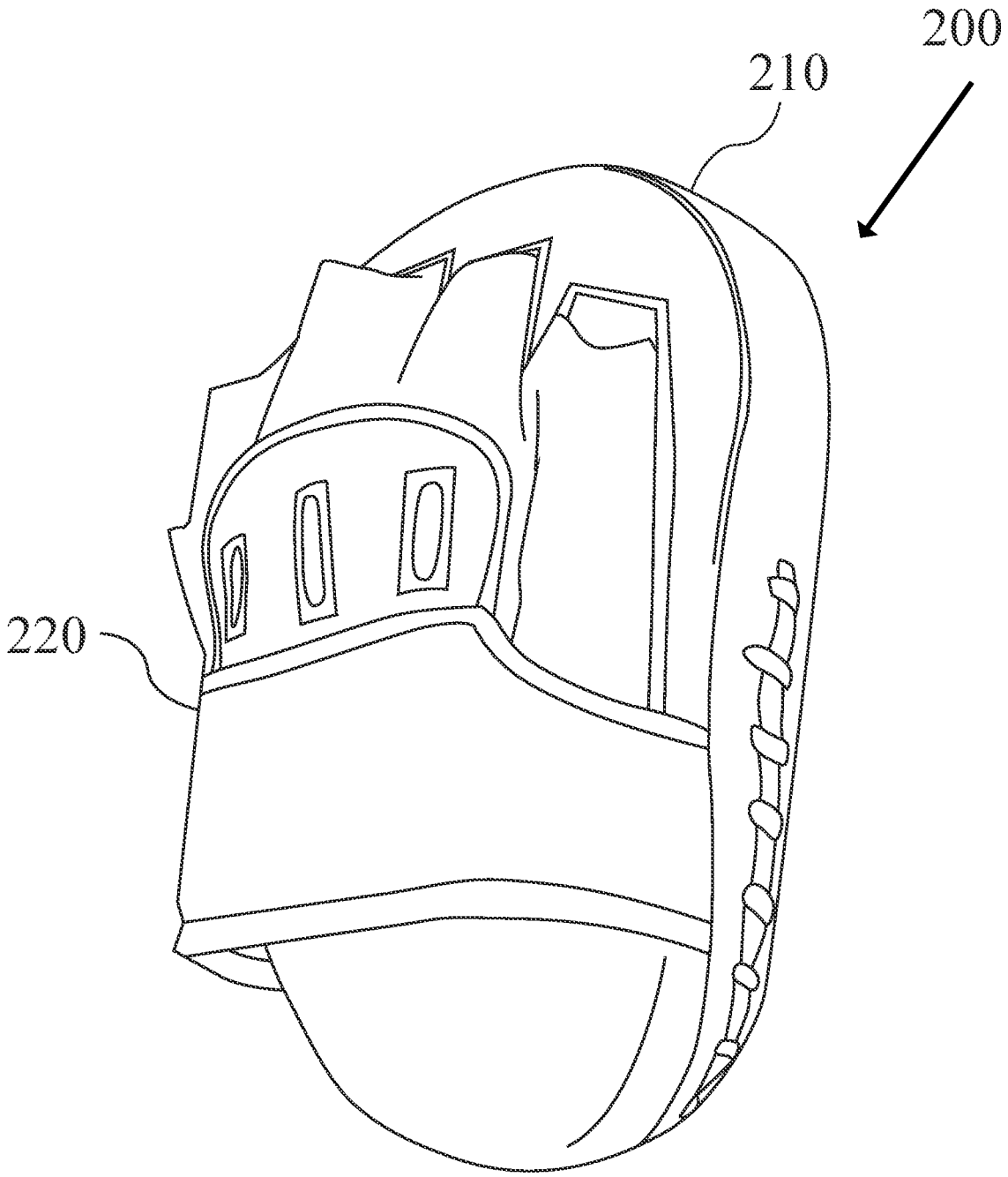
FIG. 2 is an illustration of a hand blocker.
Figure 3:
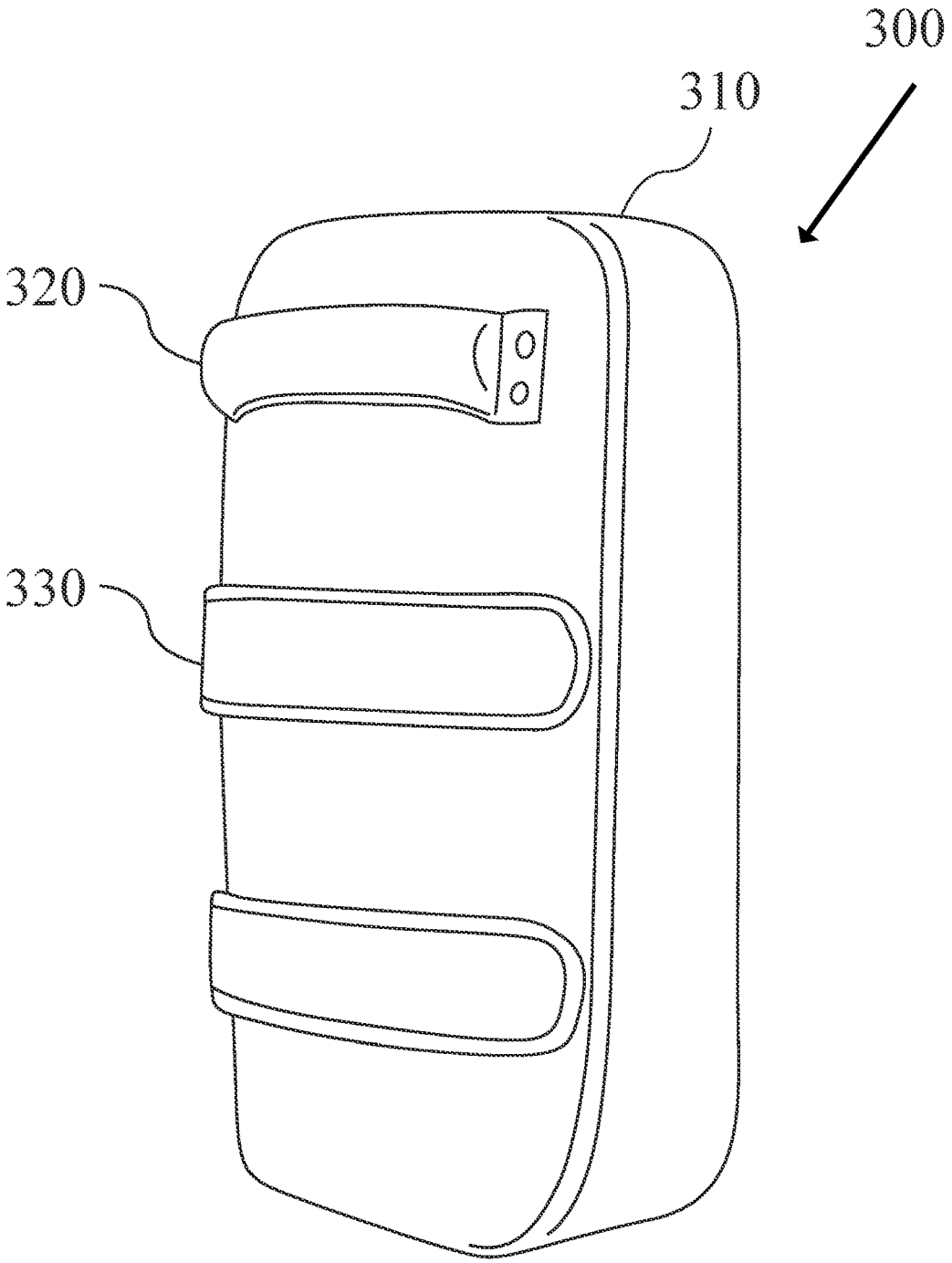
FIG. 3 is an illustration of a kick blocker.
Figure 4:
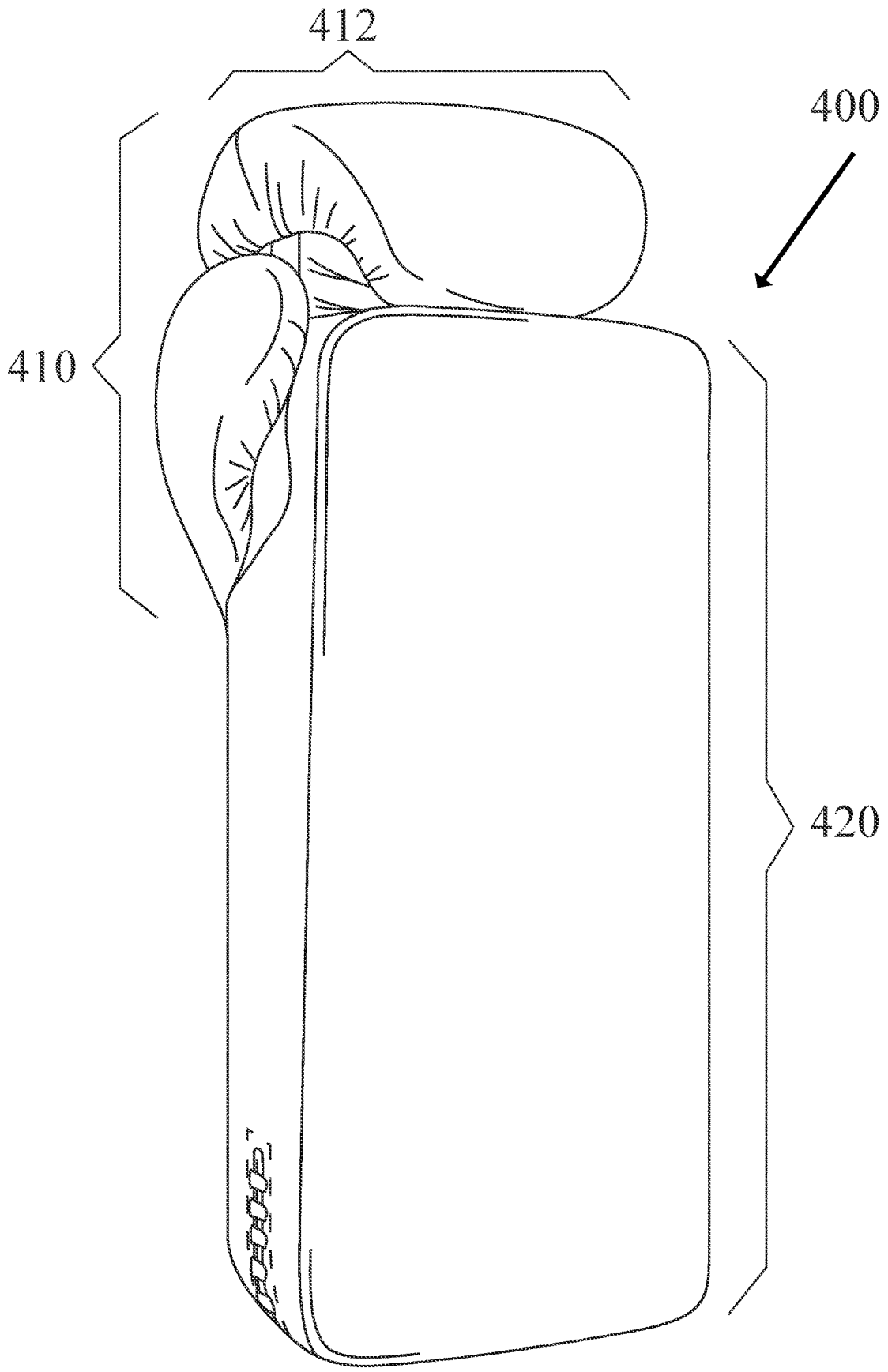
FIG. 4 is an illustration of a training glove in accordance with certain aspects of the present disclosure.

FIG. 4 shows a blocker-side view of training glove 400. Training glove 400 includes a glove portion 410 and a blocker portion 420 and a retention system (not visible).

The glove portion 410 of training glove 400 shown in FIG. 4 includes a first protective portion 412 which is disposed to cover at least a portion of the posterior (back) of the user's hand (e.g., the back side of all, or a portion of, the back of the hand and fingers) when worn by the user.

Figure 5:
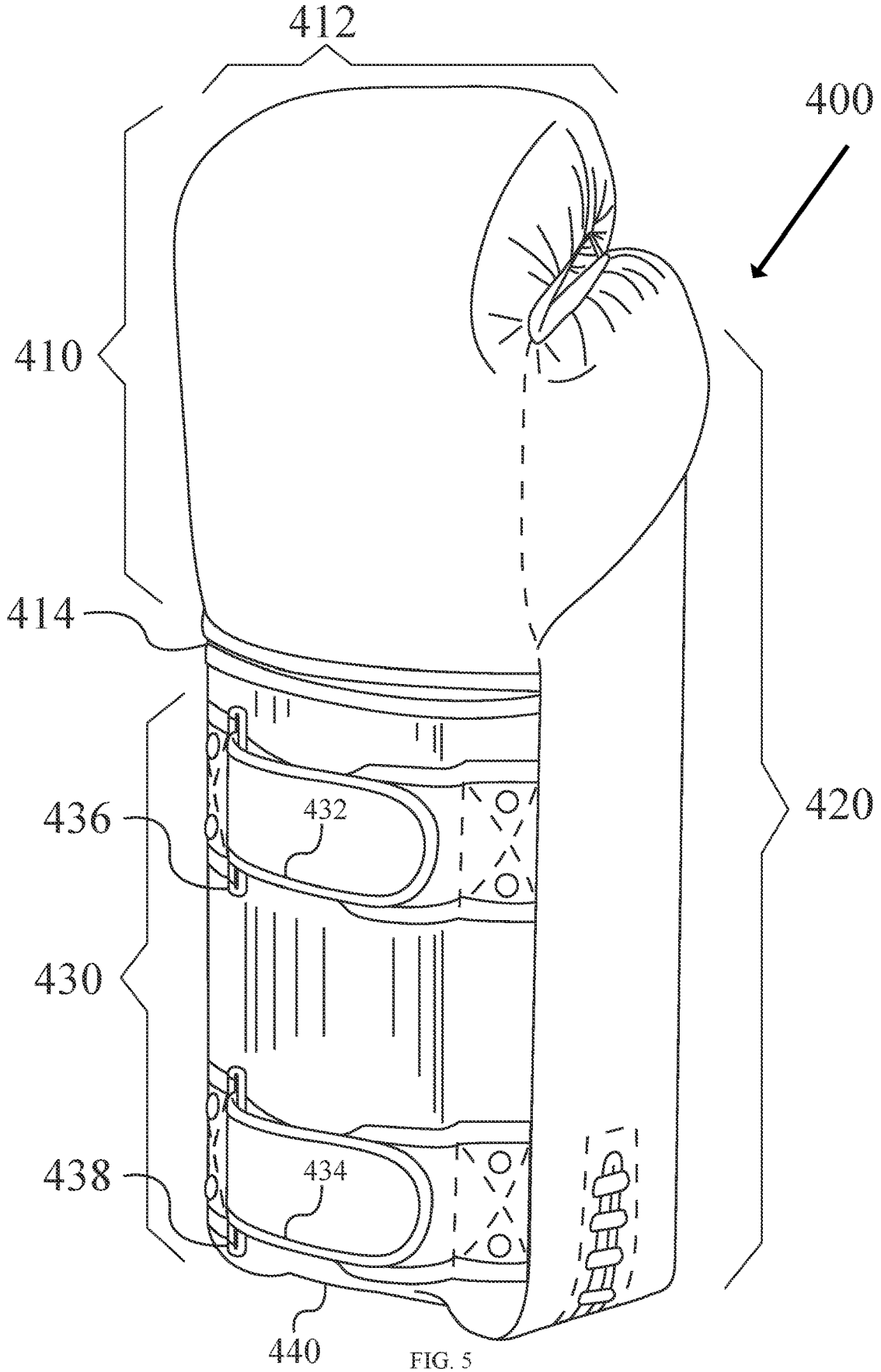
FIG. 5 is an illustration of a training glove in accordance with certain aspects of the present disclosure.

In certain aspects, the first protective portion 412 covers more than a portion of the user's hand when worn (e.g., the first protective portion extending from about the fingertips of a user to about the wrist of the user when worn by a user of training glove 400 (e.g., FIG. 4 and FIG. 5). In other aspects, the first protective portion only cover a portion of the posterior of the user's hand (e.g., a portion of the posterior of the phalanges and/or metacarpals (e.g., only the intermediate phalanges, only the proximal phalanges, etc.)). In other aspects, the first protective portion extends to cover a portion of the posterior forearm.

In certain aspects, the first protective portion 412 is similar in padding (e.g., density, layers, material, etc.) to that of a common boxing glove. It will be appreciated that using a similar padding to that of a common boxing glove may allow a user of the training glove 400 to have a familiar feel (e.g., similar to a boxing glove) when delivering counter punches to an athlete they are training. Similarly, the training athlete will receive punches that feel similar to getting hit with a boxing glove. Blocker portion 420 is secured to the glove portion (e.g., glue, fabric, sewn, integrated construction, etc.) and comprises a second protective portion disposed to cover a portion of a user's anterior forearm when worn by the user. In certain aspects, the blocker portion 420 and the second protective portion are congruent. In other aspects, the second protective portion is less than all of blocker portion 420. Blocker portion 420 is shown extending from about the palm region and extending to cover a majority of the anterior forearm when worn by a user. In certain aspects, the blocker portion may be shorter (e.g., 100 mm, etc.) or longer (e.g., 500 mm, etc.) than what is shown in FIG. 4.

It will be appreciated that relatively harder materials (e.g., denser, heavier, less compressible, etc.) may be used for padding in a portion, or all, of glove portion 410 or blocker portion 420 of training glove 400. It will be further appreciated that relatively softer materials (e.g., less dense, lighter, more compressible, etc.) may also be used for padding a portion, or all, of glove portion 410 or blocker portion 420 of training glove 400.

FIG. 5 shows a glove-side view of training glove 400 from FIG. 4. Training glove 400 in FIG. 5 includes glove portion 410, blocker portion 420, and retention system 430.

The glove portion 410 of training glove 400 shown in FIG. 4 includes a first protective portion 412 which is disposed to cover at least a portion of the posterior of the user's hand when worn by the user. It will be appreciated that in certain aspects, the first protective portion 412 covers more than a portion of a user's hand when worn. In other aspects, the first protective portion 412 only covers a portion of the posterior of the user's hand. In certain aspects, the first protective portion 412 is similar in density to that of a common boxing glove.

It will be appreciated that glove portion 410 may be discontinuous in construction (e.g., be made from mesh, made with vent holes, have a different stylistic design, etc.) without deviating from the scope of the disclosure. In certain aspects, glove portion 410 may comprise narrow padding across a portion of the posterior of a user's hand, while the remaining portions of glove portion 410 are not padded and/or entirely open (not shown). In yet other aspects, glove portion 410 may appear to extend all the way down to the bottom of the training glove 400 (e.g., to about bottom 440) for example when retention system 430 is a material sleeve that is continuous from glove portion 410 to about bottom 440 (not shown).

In certain aspects, retention system 430 is a hook and loop strap system as shown in FIG. 5. Retention system 430 includes strap 432 and 434 and metal guides 436 and 438. Straps 432 and 434 and metal guides 436 and 438 are shown attached by a combination of stitching and rivets, but it will be appreciated that any suitable attachment mechanism may be used (e.g., glue, thread, rivets, hook and loop, molded, cut material as part of blocker portion 420 (e.g., same piece of leather, synthetic material, etc.), etc.).

In FIG. 5, straps 432 and 434 are shown riveted and sewn to the back side of blocker portion 420 and below glove portion 410. In certain aspects, a user (e.g., a trainer, etc.)

may insert their hand into glove portion 410 at access 414 and then securely attach their forearm to the device using retention system 430 (e.g., by wrapping straps 432 and strap 434 over the posterior of their forearm, though metal loop 436 and metal loop 438, and then fastened by hook and loop to strap 432 and strap 434, thereby securing the training glove 400 to the user. In certain aspects, both straps may be used, but in other aspects, only one strap may be used (e.g., based on time, comfort, body size, etc.). In yet other aspect, more than two straps may be used for retention system 430.

It will be appreciated that other dimensions for training glove 400 are contemplated herein and in certain aspects dimensions may be altered based on information known in the art (e.g., athlete sizing, impact strength, material properties, etc.) without deviating from the scope of the disclosure.

Figure 6A:
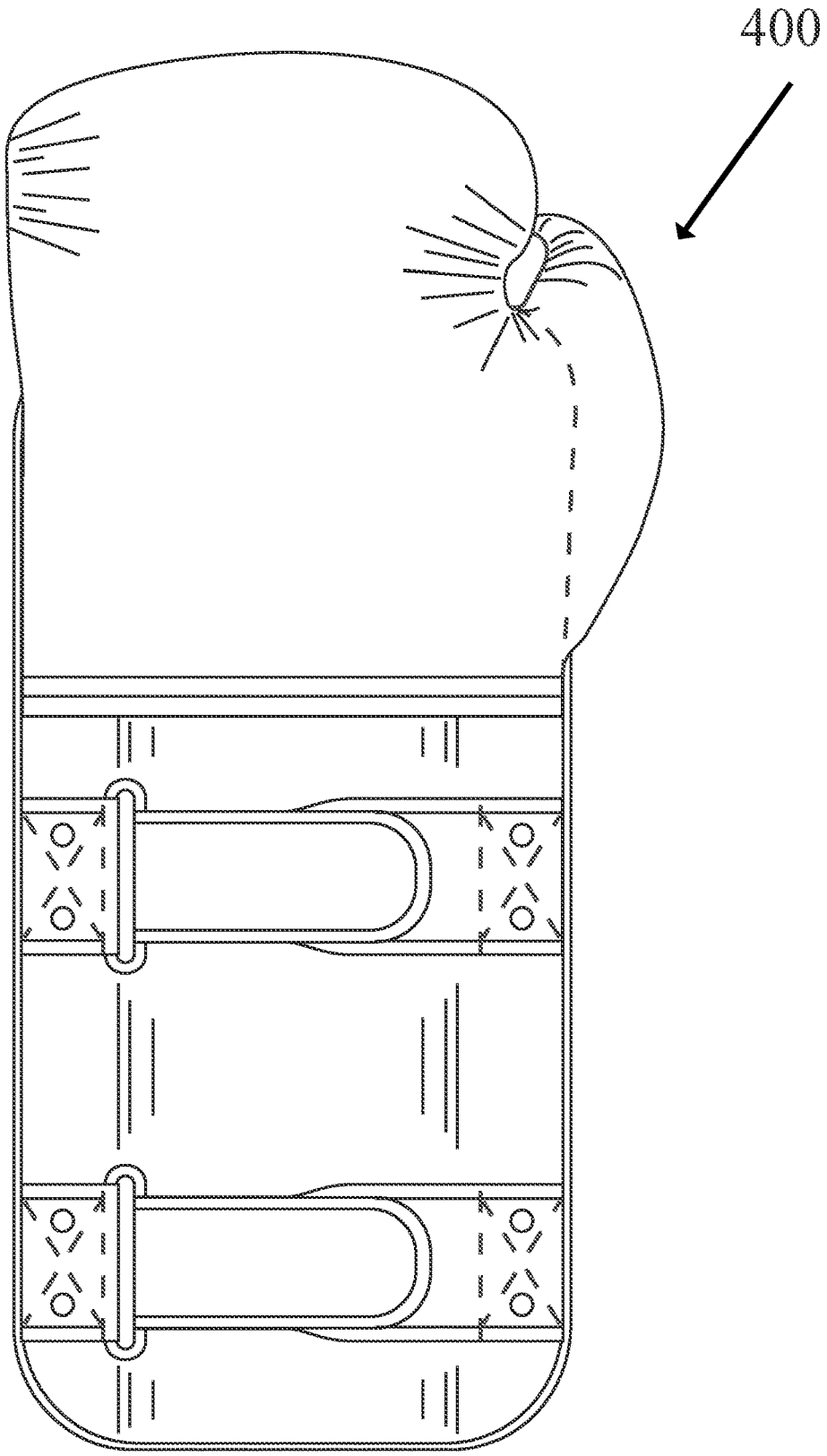
FIGS. 6A through 6F are illustrations of a training glove in accordance with certain aspects of the present disclosure.
Figure 6B:
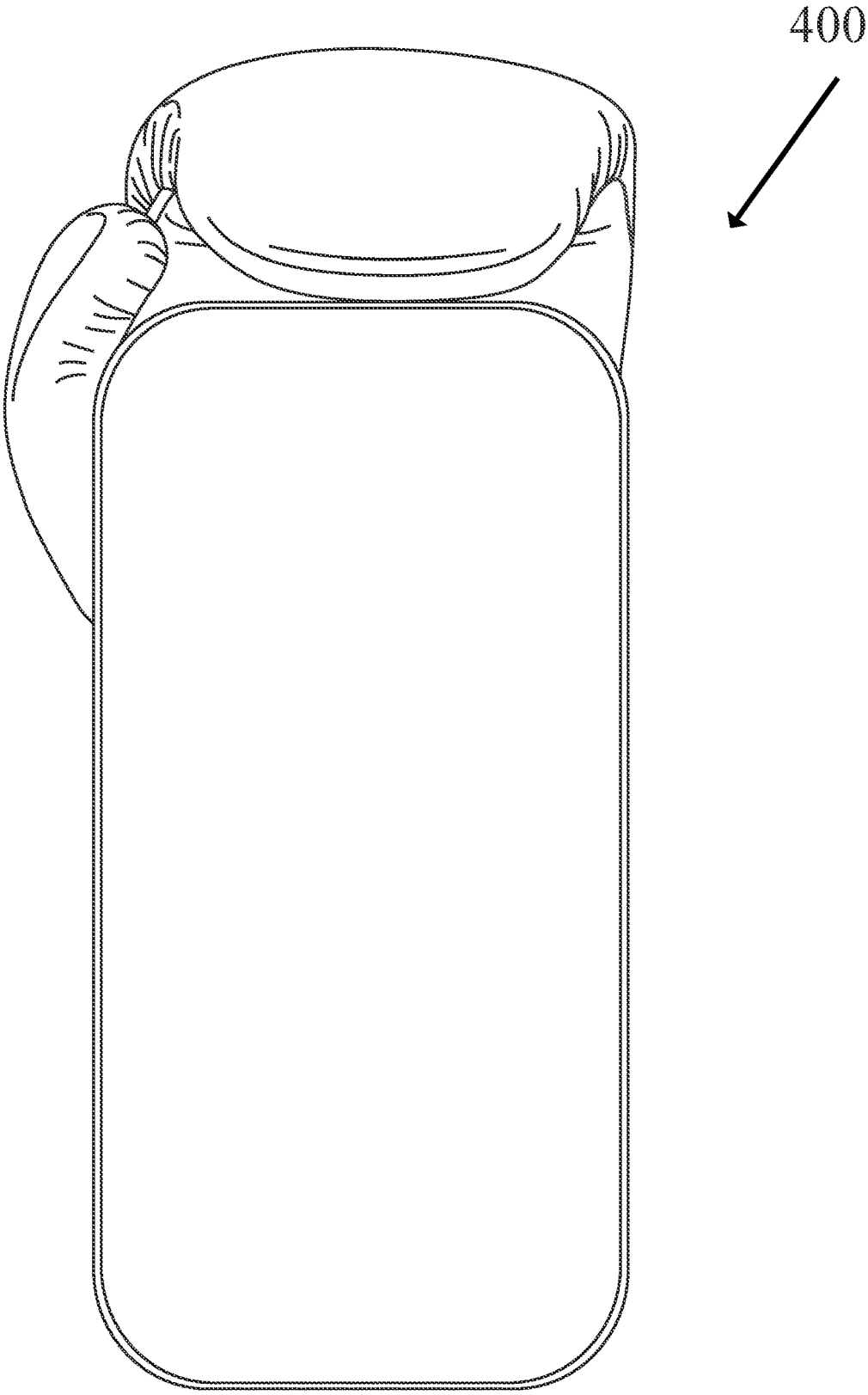
Figure 6C:
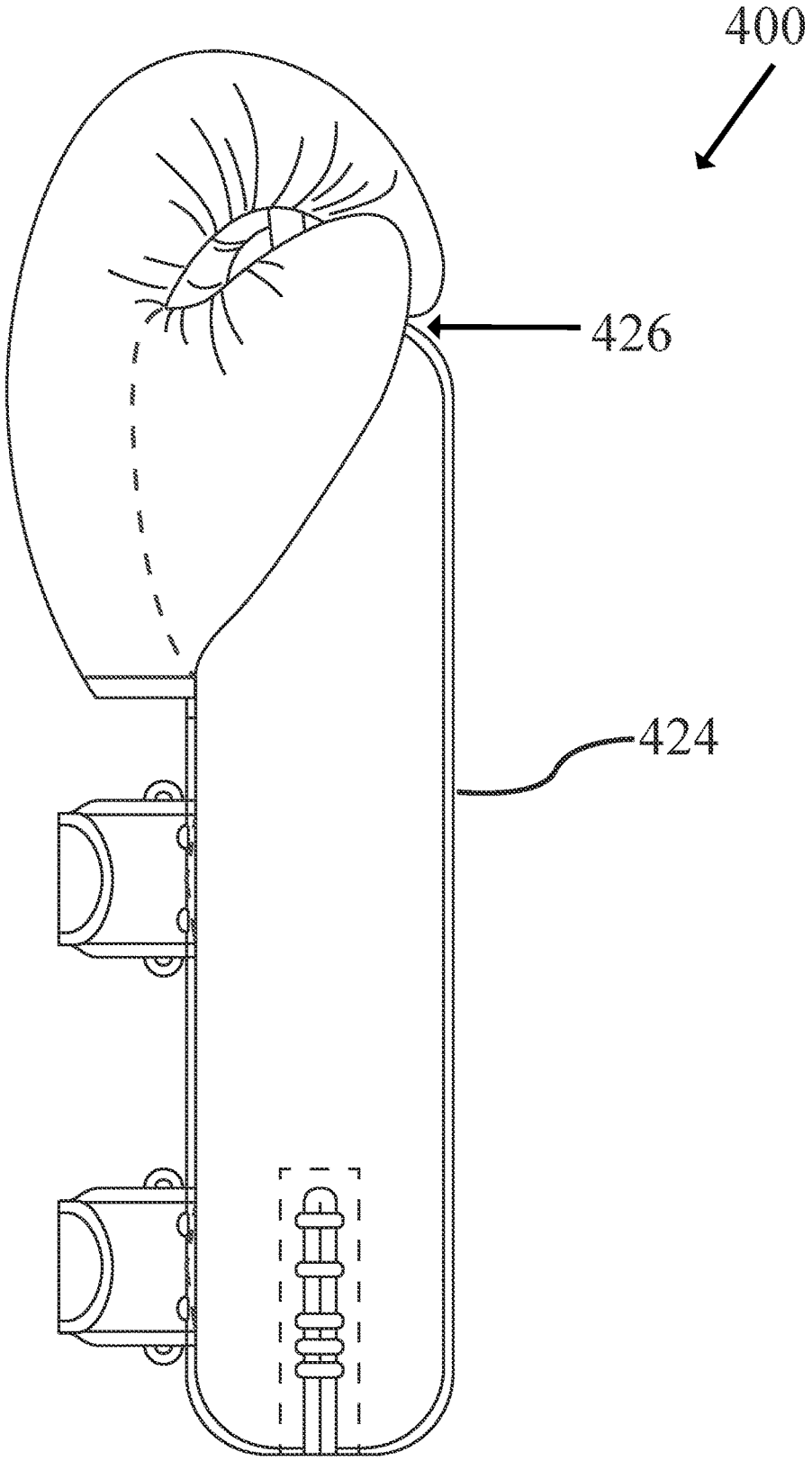
Figure 6D:
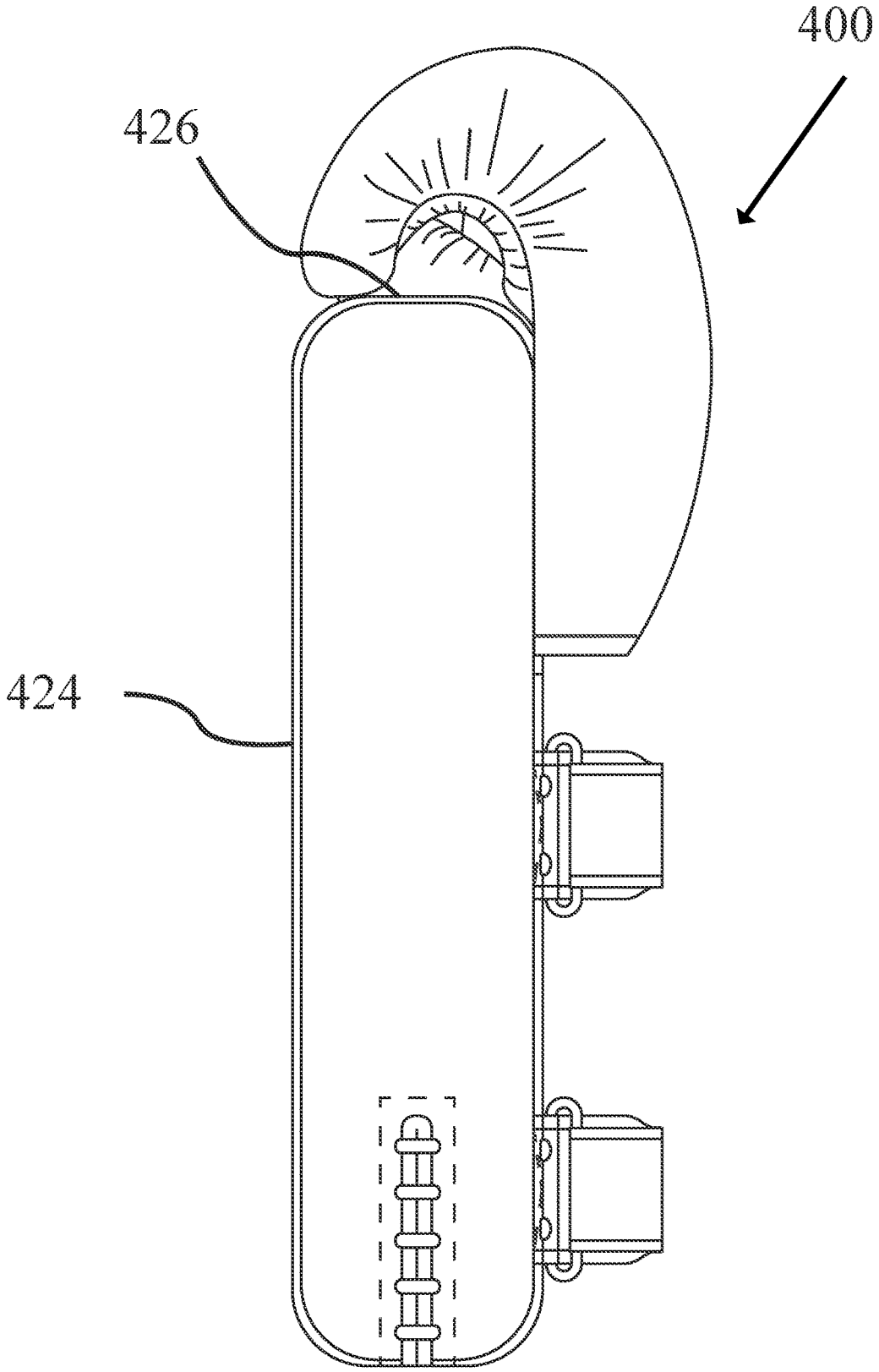
Figure 6E:
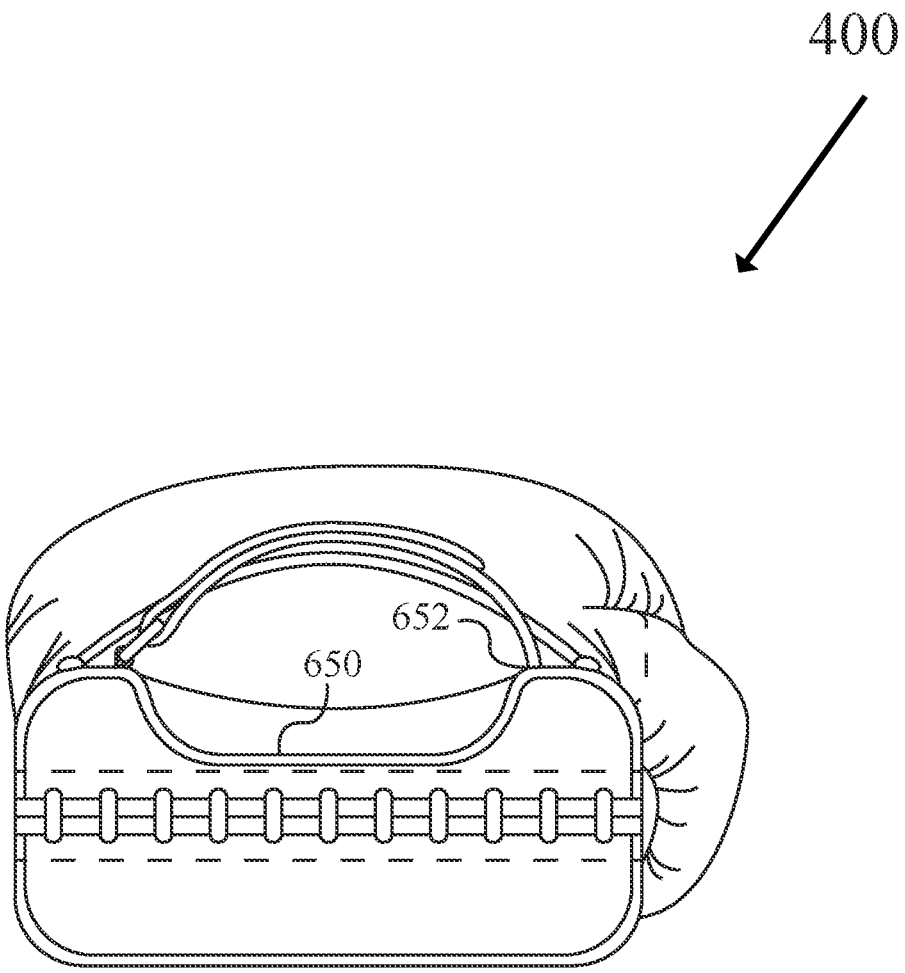

FIGS. 6A through 6F show certain aspects of the training glove 400 shown in FIGS. 4 and 5. More specifically 6A shows a glove-side view of training glove 400. FIG. 6B shows a blocker-side view of training glove 400. FIG. 6C shows a thumb-side view of training glove 400. FIG. 6D shows a small finger-side view of training glove 400. FIG. 6E shows a bottom view of training glove 400. As shown in FIGS. 6C and 6D, first protective portion 412 of glove portion 410 of training glove 400 extends above and over a top surface 426 of blocker portion 420 without extending past an anterior surface 424 of blocker portion 420.

Figure 6F:
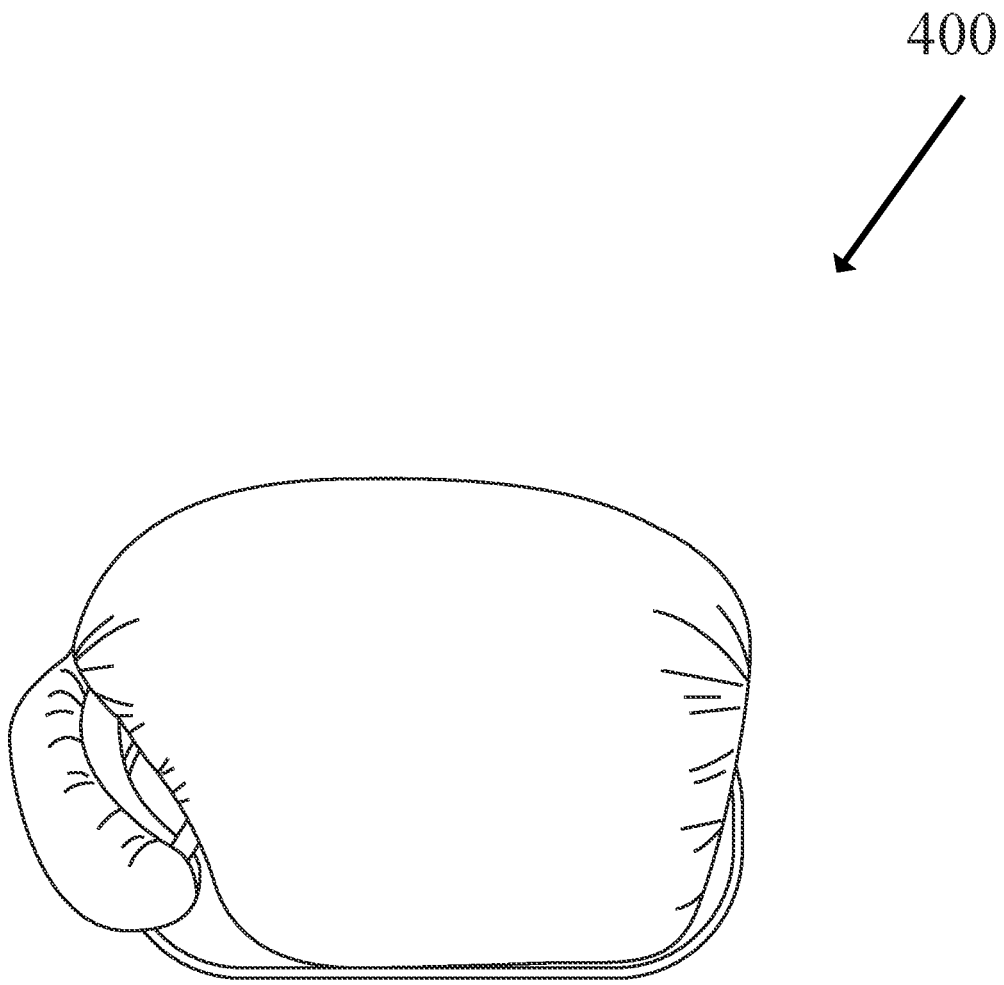

Further shown in FIG. 6E is recessed area 650 wherein recessed area 650 is of sufficient depth so that a portion of a user's arm may fit below the level 652 of the blocking portion on the glove side of the training glove when the training glove 400 is worn by a user. While training glove 400 is shown with recessed area 650 of a certain depth (about 15 mm), recessed area 650 may be of any sufficient depth (e.g., a shallow depth (between 0 mm and 20 mm), or a deep depth (between 20 mm and 60 mm) etc.). It will be appreciated that recessed area 650 may add stability to the training glove 400 (e.g., by changing the center of mass and/or moment of inertia of the training glove, etc.). FIG. 6F shows a top view of training glove 400.

Figure 7:
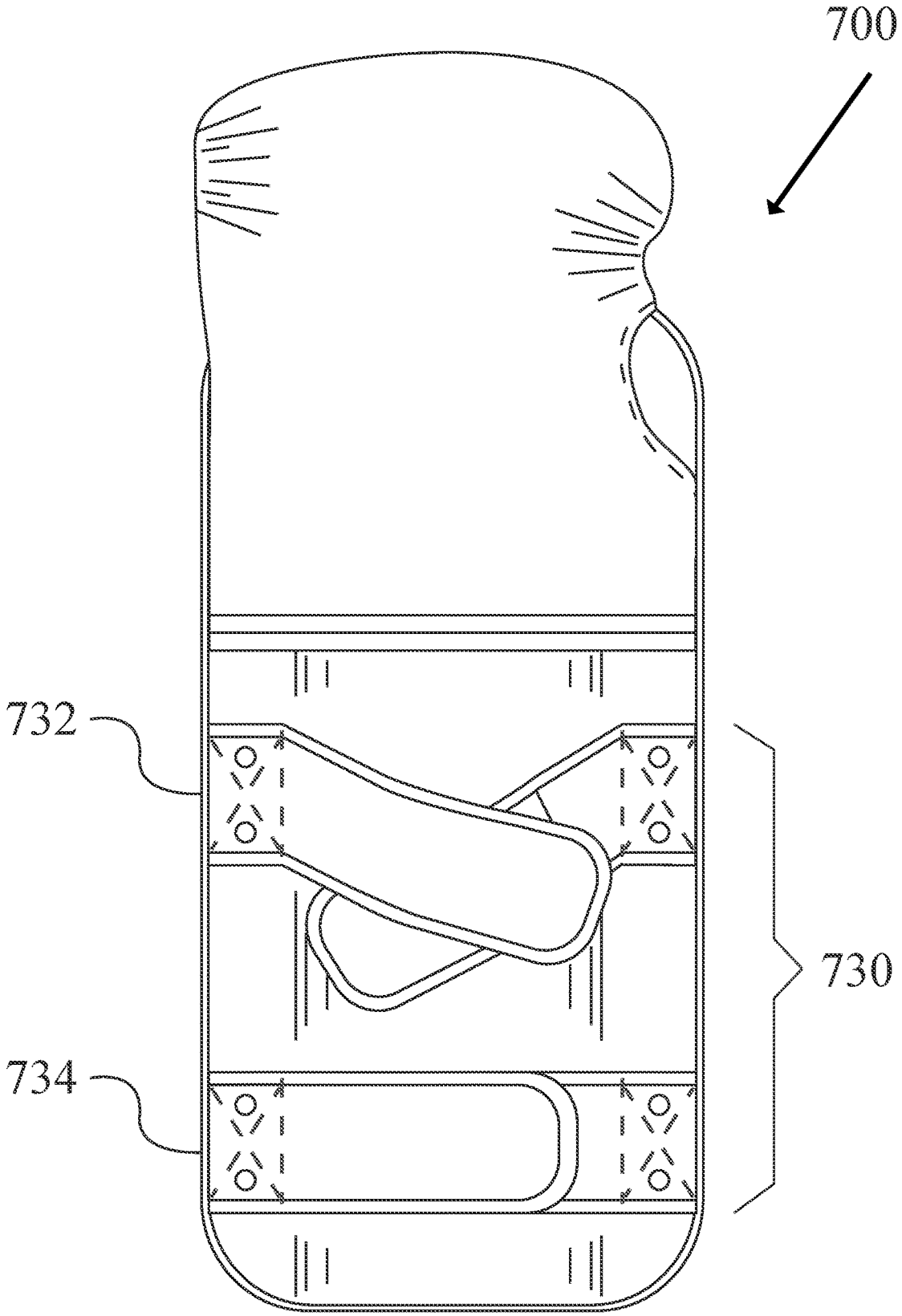
FIG. 7 is an illustration of a training glove in accordance with certain aspects of the present disclosure.

FIG. 7 shows training glove 700 with retention system 730 that may be used in accordance with certain aspects of the disclosure. Retention system 730 includes straps 732 and 734 which may be secured using hook and loop fastening or another suitable fastening system (e.g., buttons, clasps, tied, etc.). In certain aspects retention system 730 may be preferable to retention system 430 of FIG. 4 (e.g., as there is less metal components included in training glove 700).

Figure 8:
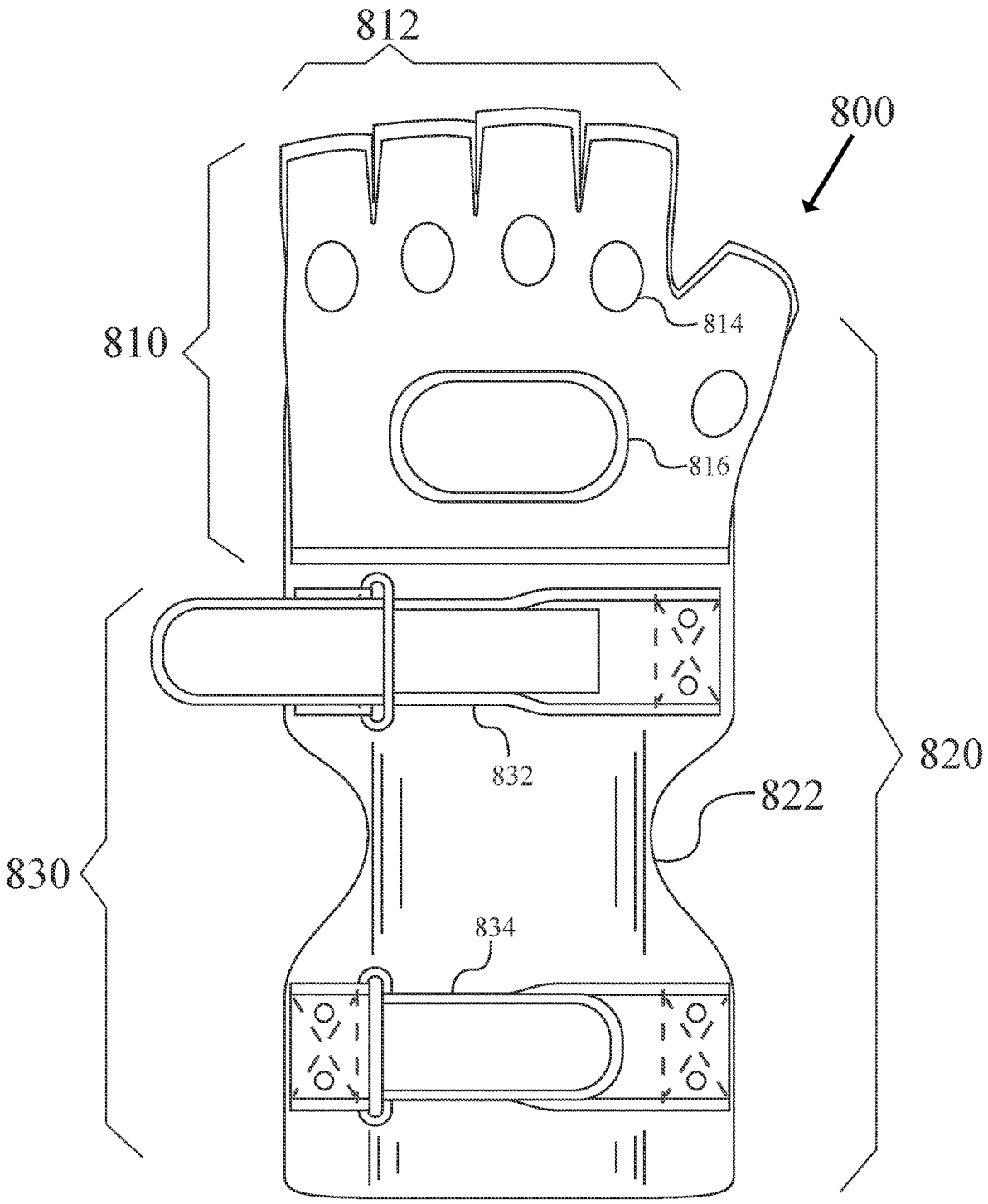
FIG. 8 is an illustration of a training glove in accordance with certain aspects of the present disclosure.

FIG. 8 shows training glove 800 in accordance with certain aspects of the present disclosure. Training glove 800 includes a glove portion 810, a blocker portion 820, and a retention system 830.

The glove portion 810 of training glove 800 shown in FIG. 8 includes a first protective portion 812 which is disposed to cover at least a portion of the posterior of the user's hand (e.g., the back side of all, or a portion of the hand and fingers,) when worn by the user.

The first protective portion 812 in FIG. 8 includes open portions 814 and 816 (e.g., to vent heat, improve comfort and/or be more aesthetically pleasing, etc.). The first protective portion 812 in FIG. 8 is similar in construction to a hockey glove wherein the protective portion 812 includes padding disposed in separated sections across the posterior or a portion of a user's hand, when worn by a user (e.g., a portion of the posterior of the phalanges and/or metacarpals (e.g., only the intermediate phalanges, only the proximal phalanges, etc.)). In certain aspects, the first protective portion 812 is similar in density to that of a common boxing glove. In other aspects, the density is similar to the density of a common hockey glove, a mixed martial arts glove, or comprises multiple densities. In other aspects, training glove 800 may not separate each finger (e.g., having two sections or three sections compared to the four shown in FIG. 8 or the one shown in FIG. 6).

It will be appreciated that using a similar padding to that of a common boxing glove may allow a user of the training glove 800 to have a familiar feel (e.g., similar to a boxing glove) when delivering counter punches to an athlete they are training. Similarly, the training athlete will receive counter punches that feel similar to getting hit with a common boxing glove. In other aspects, using a similar padding to that of a thinner mixed marshal arts glove may allow a user of the training glove 800 to have a familiar feel (e.g., similar to a mixed marshal arts glove) when delivering counter punches to an athlete they are training. Similarly, the training athlete will receive counter punches that feel similar to getting hit with a mixed marshal arts glove.

It will be appreciated that relatively harder materials (e.g., denser, heavier, less compressible, etc.) may be used for padding in a portion, or all, of glove portion 810 of training glove 800. It will be further appreciated that relatively softer materials (e.g., less dense, lighter, more compressible, etc.) may also be used for padding a portion, or all, of glove portion 810 of training glove 800.

FIG. 8 further includes a blocker portion 820. Blocker portion 820 is secured to the glove portion 810 and includes a second protective portion disposed to cover a portion of a user's anterior forearm when worn by the user. It will be appreciated that the blocker portion 820 and the second protective portion may be congruent, or in other aspects, the second protective portion may be less than the entire blocker portion 820 (e.g., using grid padding, padding only certain portions of blocker portion 820.)

As shown in FIG. 8, blocker portion 820 includes cutouts 822. Cutouts 822 may be of various shapes and sizes so long as the second protective portion is disposed to cover at least a portion of a user's anterior forearm when worn by the user. It will be appreciated that the blocker portion 820 of training glove 800 in FIG. 8 may be preferable over the blocker portion 420 of training glove 400 in FIG. 4 because it may be lighter and/or more aesthetically pleasing.

Training glove 800 includes retention system 830 that includes straps 832 and 834, which are hook and loop type retaining components.

Figure 9:
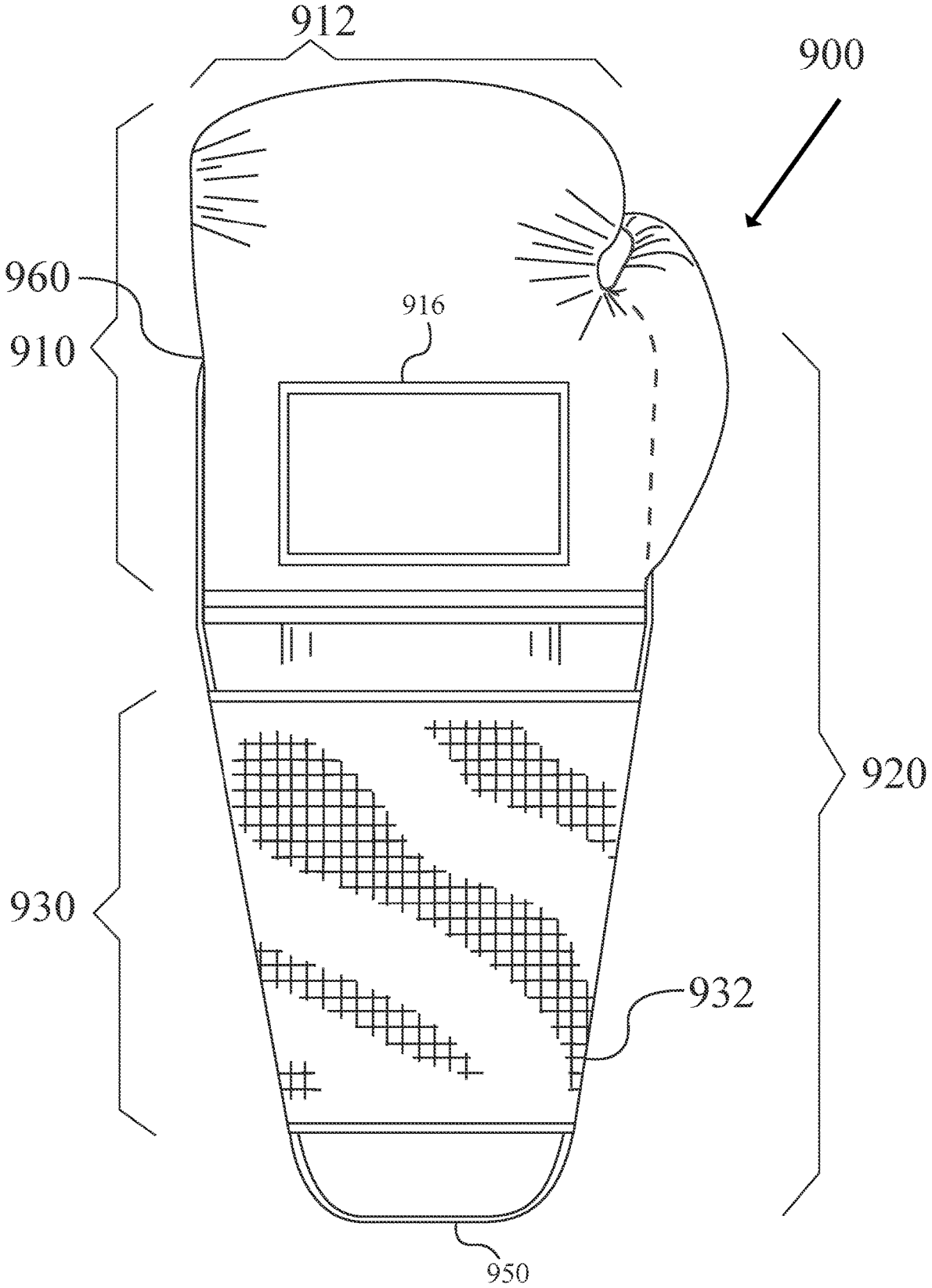
FIG. 9 is an illustration of a training glove in accordance with certain aspects of the present disclosure.

FIG. 9 shows a glove-side view of training glove 900 in accordance with certain aspects of the present disclosure. Training glove 900 includes a glove portion 910, blocker portion 920, and retention system 930.

The glove portion 910 of training glove 900 shown in FIG. 9 includes a first protective portion 912 which is disposed to cover at least a portion of the posterior of a user's hand when worn by the user. The first protective portion 912 in FIG. 9 includes a portion 916 of different density padding (e.g., a denser padding (e.g., to alter the protection on selected portions of the hand), etc.). The first protective portion 912 in FIG. 9 is similar in construction to a boxing glove wherein the first protective portion 912 includes padding disposed across a portion of the posterior of a user's hand, when worn.

FIG. 9 further includes a blocker portion 920. Blocker portion 920 is secured to the glove portion 910 and includes a second protective portion disposed to cover a portion of a user's anterior forearm when worn by the user. It will be appreciated that the blocker portion 920 and the second protective portion may be congruent, as is shown in FIG. 9. In other aspects, the second protective portion may be less than the entire blocker portion 920.

As shown in FIG. 9, blocker portion 920 is tapered, wherein the blocker portion 920 is narrower at the bottom end 950 than the top end 960 of blocker portion 920. The taper between the bottom end 950 of blocker portion 920 and the top end 960 of blocker portion 920 may vary (e.g., bottom end 950 and top end 960 are substantially similar in width and thickness, bottom end 950 is larger than top end 960 in width and/or thickness, bottom end 950 is smaller than top end 960 in width and/or thickness, etc.).

Training glove 900 further includes retention system 930, wherein retention system 930 includes fabric 932 (e.g., natural or synthetic fabric or mesh (e.g., leather, plastic, nylon, elastic, combination thereof, etc.).

It will be appreciated that a user of training glove 900 may quickly insert their hand into glove portion 910 by inserting their hand first though retention system 930, wherein retention system 930 generates sufficient force to keep blocker portion 920 substantially secure during use. In certain aspects, one or more components, or portions of components, may be removable (e.g., removing one or more components (e.g., the retention system, blocker portion, glove portion, padding, cover, etc.) (e.g., to aid in washing, replacement parts, etc.).

Figure 10:
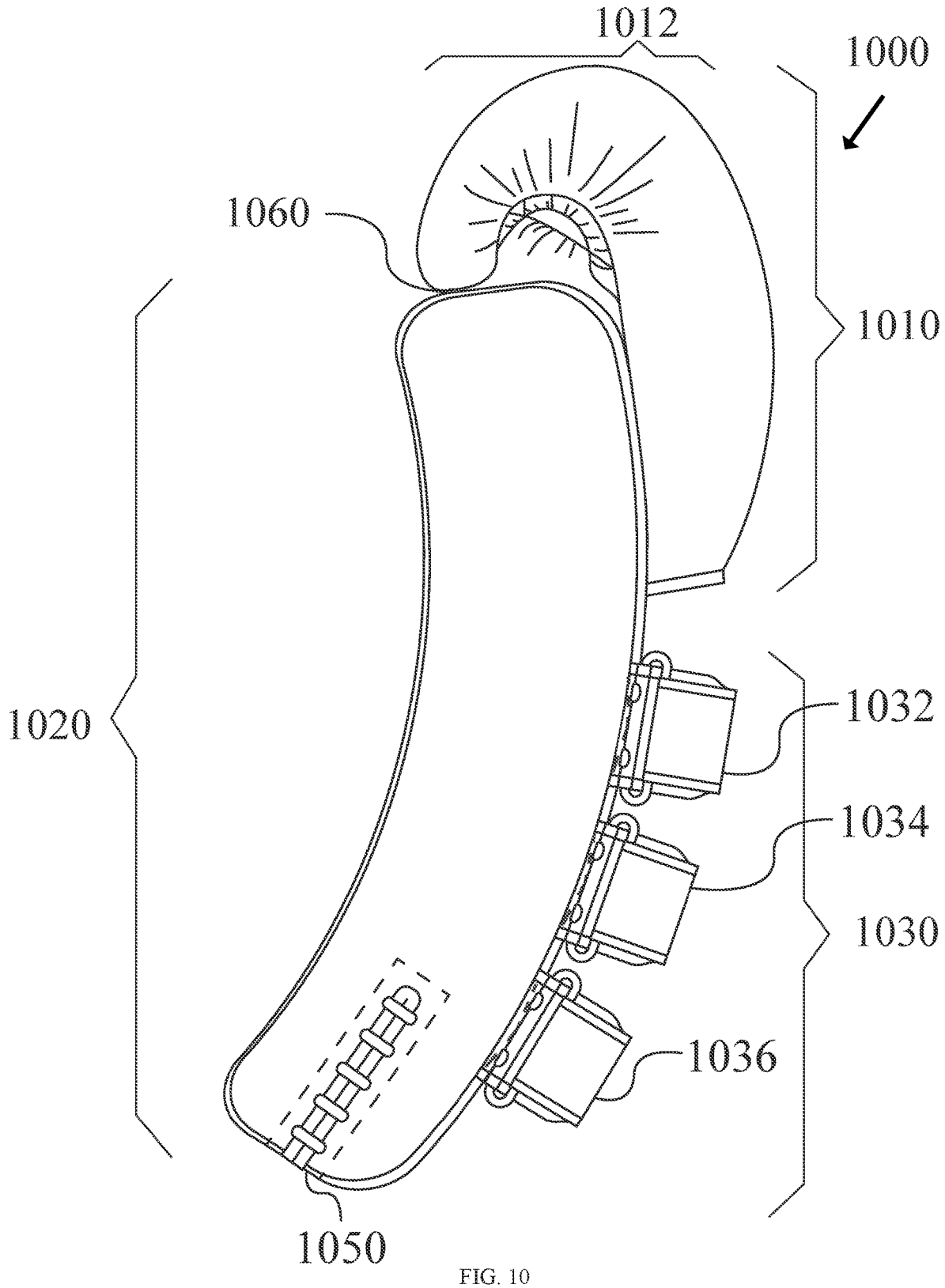
FIG. 10 is an illustration of a training glove in accordance with certain aspects of the present disclosure.

FIG. 10 shows a small-finger-side view of training glove 1000 in accordance with certain aspects of the present disclosure. Training glove 1000 includes a glove portion 1010, blocker portion 1020, and retentions system 1030.

The glove portion 1010 of training glove 1000 shown in FIG. 10 includes a first protective portion 1012 which is disposed to cover at least a portion of the posterior of a user's hand when worn by the user. It will be appreciated that the glove portion 1010 and the first protective portion may be congruent, as is shown in FIG. 10. In other aspects, the first protective portion may be less than the entire glove portion 1010.

FIG. 10 further includes a blocker portion 1020. Blocker portion 1020 is secured to the glove portion 1010 and includes a second protective portion disposed to cover a portion of a user's anterior forearm when worn by the user. It will be appreciated that the blocker portion 1020 and the second protective portion may be congruent, as is shown in FIG. 10. In other aspects, the second protective portion may be less than the entire blocker portion 1020.

As shown in FIG. 10, blocker portion 1020 is curved away from the anterior forearm when worn by a user of training glove 1000. In other aspects, blocker portion 1020 is curved towards the anterior forearm when worn by a user of training glove 1000. It will be appreciated that there need not be symmetry to the glove portion 1010, blocker portion 1020, or retention system 1030.

In certain aspects the bottom end 1050 of blocker portion 1020 and the top end 1060 of blocker portion 1020 are substantially similar in width and thickness. In other aspects, bottom end 1050 is larger than top end 1060 in width and/or thickness. In yet other aspects, bottom end 1050 is smaller than top end 1060 in width and/or thickness.

Training glove 1000 further includes retention system 1030, wherein retention system 1030 includes straps 1032, 1034, and 1036.

The training gloves disclosed herein (e.g., training gloves 400-1000 as shown in FIGS. 4 through 10) may be used for training using the method of wearing a training glove; and training a person using the training glove. In certain aspects, the method includes receiving a strike from a person while wearing the training glove. In other aspects, the method includes delivering a strike to a person or object person while wearing the training glove. In certain aspects, the method of wearing a training glove in accordance with the present invention includes inserting a hand into the glove portion of a training glove (e.g., training glove 400-1000 as shown in FIGS. 4 through 10) and securing a blocker portion of the training glove to the anterior forearm using a retention system.

In certain aspects, the reference to the singular form of a word may also refer to the plural, and a reference to the plural form of a word may refer to the singular thereof. While some of the advantages of the roundnet disclosed herein are provided, the advantages are not limited to those described herein, as one of ordinary skill in the art will appreciate more advantages and embodiments than those explicated listed or described herein.

What is claimed is:

1. A training glove configured to be worn by a user, comprising:

a glove portion, wherein the glove portion comprises a first protective portion configured to cover at least a portion of a posterior of a hand of the user;

a blocker portion including a recessed area comprising a cavity having a depth configured to stabilize an arm of the user by way of changing a center of mass of the training glove, wherein the blocker portion is secured to the glove portion and comprises a second protective portion configured to cover an anterior portion of the user's forearm when worn by the user, and a retention system coupled to the blocker portion and/or the glove portion and configured to secure the hand and/or the forearm of the user to the blocker portion;

wherein the first protective portion of the glove portion of the training glove extends above and over a top surface of the blocker portion without extending past an anterior surface of the blocker portion.

2. The training glove of claim 1, wherein the first protective portion is configured to cover the entire posterior of the hand of the user.

3. The training glove of claim 1, wherein the first protective portion comprises two or more types of padding.

4. The training glove of claim 1, wherein the anterior surface of the blocker portion is at least partially curved away from or towards the covered anterior portion of the user's forearm.

5. The training glove of claim 1, wherein the second protective portion is configured to cover the entire length of the user's anterior forearm.

6. The training glove of claim 1, wherein the second protective portion comprises two or more types of padding.

7. The training glove of claim 1, wherein the second protective portion is substantially planar.

8. The training glove of claim 1, wherein the second protective portion is configured to cover a portion of the anterior of the user's hand when worn by the user.

9. The training glove of claim 1, wherein the glove portion is removable.

10. The training glove of claim 1, wherein the blocker portion is removable.

11. The training glove of claim 1, wherein the retention system comprises at least one strap.

12. The training glove of claim 1, wherein the retention system comprises a hook and loop material.

13. The training glove of claim 1, wherein the retention system comprises a sleeve.

14. The training glove of claim 1, wherein the retention system is adjustable.

15. The training glove of claim 1, wherein the depth is less than 20 mm.

16. The training glove of claim 1, wherein the depth is between 20 mm and 60 mm, inclusive.

17. The training glove of claim 1, wherein the glove portion is configured for curling fingers of the user into at least a partial fist for delivering counter-punches when worn by the user.

18. A method of training using a training glove, the method comprising:

providing the training glove, wherein the training glove comprises:

a glove portion, wherein the glove portion comprises a first protective portion configured to cover at least a portion of a posterior of a hand of a user;

a blocker portion including a recessed area comprising a cavity having a depth configured to stabilize an arm of the user by way of changing a center of mass of the training glove, wherein the blocker portion is secured to the glove portion and comprises a second protective portion configured to cover an anterior portion of the user's anterior forearm when worn by the user, and a retention system coupled to the blocker portion and/or the glove portion and configured to secure the hand and/or the forearm of the user to the blocker portion;

wherein the first protective portion of the glove portion of the training glove extends above and over a top surface of the blocker portion without extending past an anterior surface of the blocker portion;

directing impacts with the glove portion of the training glove;

receiving impacts with the blocker portion of the training glove; and securing the training glove using the retention system.

* * * * *